United States Patent [19]

Bausch et al.

[11] 3,986,320

[45] Oct. 19, 1976

[54] APPARATUS FOR FILLING AND SEALING AMPULES

[75] Inventors: Wilhelm Leonhard Bausch, Ilshofen; Siegfried Bullinger, Crailsheim, both of Germany

[73] Assignee: Bausch & Strobel, Maschinenfabrik, Ilshofen, Germany

[22] Filed: Oct. 17, 1974

[21] Appl. No.: 515,483

[30] Foreign Application Priority Data

Oct. 19, 1973 Germany ..... 2352646

[52] U.S. Cl. ..... 53/63; 53/266 R; 53/278; 141/137

[51] Int. Cl.[2] ..... B65B 57/06; B65B 3/10

[58] Field of Search ..... 53/63, 266, 276, 278, 53/279, 280, 282; 141/137

[56] References Cited

UNITED STATES PATENTS

| | | | |
|---|---|---|---|
| 584,891 | 6/1897 | Pierce | 141/137 X |
| 2,530,230 | 11/1950 | Cozzoli | 53/266 X |
| 2,581,898 | 1/1952 | Alexander et al. | 141/137 X |
| 3,191,643 | 6/1965 | Roth | 141/137 |
| 3,328,937 | 7/1967 | Newman et al. | 53/282 |

*Primary Examiner*—Travis S. McGehee
*Attorney, Agent, or Firm*—Karl F. Ross; Herbert Dubno

[57] ABSTRACT

An apparatus for filling and sealing ampules has a support disc rotatable about an upright axis and provided along its outer edge with a succession of seats formed by rollers. Ampules are pressed into these seats by an endless belt spanned around the disc, or by a plurality of pressing wheels. The pressing wheels or the belt are driven so that the ampules are rotated in place in their seats during the filling and sealing operations. A tool carrier, which is pivotal about the axis of rotation of the support disc, angularly oscillates back and forth over a limited arc and the tools carried on this carrier are displaced at the same angular speed as the continuously displaced ampules so that they act on the ampules as they move in the forward direction, then return and act on the next ampule or group of ampules. These tools can be filling or sealing units.

29 Claims, 12 Drawing Figures

APPARATUS FOR FILLING AND SEALING AMPULES

FIELD OF THE INVENTION

The present invention relates to an apparatus for filling and sealing ampules. More particularly this invention concerns a system for automatically filling ampules and thereafter heatsealing their ends.

BACKGROUND OF THE INVENTION

Various products, usually of a pharmaceutical nature, are packaged in ampules which insure a perfectly hermetic seal and totally eliminate the possibility of evaporation of the contents or contamination thereof. The ampules are usually subjected to various procedures such as warming, flame-treating, pregasing, filling, after-gasing, rewarming, and finally sealing.

In order to lower unit cost of products packaged in ampules at least the filling and sealing operations are usually carried out in an automatic device having a pair of stations lying on a transport path. The succession of the ampules is displaced along the transport path from one station to the next. Since the operation must be carried out with a certain degree of precision the ampules are advanced stepwise, with the filling and sealing operations being carried out as the ampules are stopped in the respective stations.

The ampules are either advanced by so-called cells carried on an endless belt or chain, or by an advance rake having fingers that are reciprocated both in and parallel to the transport direction. The fingers of the rake each push along a single respective ampule a single step in the transport direction, then withdraw laterally from the transport path, move backward a step, and again move transverse to the transport direction behind the next succeeding ampule to similarly displace it one step forward.

It is frequently necessary during the heating and sealing of the ampules to rotate them about their own longitudinal axes. To this end a large drive roller covered with elastic material is provided adjacent each of the treatment stations which requires such rotation in order to insure proper treatment. For filling it is also necessary to provide adjacent each of the filling stations rather complicated centering devices, as the tips of the ampules frequently do not lie directly on their longitudinal axes. Thus these devices are often expensive and complicated.

In addition a frequent problem with such an automatic filling and sealing apparatus is breakage of the ampules. This is caused mainly by the brusque stepwise advance of the succession of ampules. In addition the manner in which they are fed into the transport path and the manner in which they are removed from this path is often relatively likely to cause breakage.

Another disadvantage of the known automatic filling and sealing machines is that they are very large. For instance in a known machine wherein four ampules are treated at a time in each treatment station the distance between the input and output ends of the transport path is 4 meters. Thus it is very difficult for a single person to oversee the operation of the machine at both the input and output ends, usually two operators being necessary for controlling the machine.

OBJECTS OF THE INVENTION

It is therefore an object of the present invention to provide an improved apparatus for filling and sealing ampules.

Yet another object of this invention is the provision of such a sealing and filling apparatus which is simple and compact.

A further object is to provide an automatic filling and sealing apparatus in which breakage of the ampule is almost impossible.

SUMMARY OF THE INVENTION

These objects are attained according to the present invention in an apparatus provided with transport means which advances a succession of ampules along the transport path in a transport direction at a substantially constant advancement rate from the input end to the output end of the transport path.

Along the path there are a tool for filling the ampules as they pass by the filling station and a tool for sealing the ampules as they pass through a sealing station. In addition means is provided for alternately displacing these tools stepwise at the advancement rate of the ampules along the path in the transport direction and opposite the direction at another rate. Thus in accordance with the present invention the ampules are continuously displaced along the transport path and are therefore subject to very few potentially damaging shocks.

In accordance with yet another feature of this invention the means defining the transport path is a generally circular and horizontal plate having an array of angularly equispaced seats around its circular outer periphery. The input end and output end of the path therefore can be arranged right next to each other so as greatly to reduce the overall size of the machine, and to allow a single operator to survey both the input and output magazines.

According to yet another feature of this invention the support plate is provided at its periphery with an array of angularly equispaced rollers which define the seats and between which the ampules are pressed by means which also imparts to each of these ampules, as it is pressed between a pair of such rollers, a rotary motion. This pressing means according to the present invention is an endless belt having an inner stretch which runs along the nearly circular transport path. Means is provided for displacing this belt as a variable peripheral speed. So long as the peripheral velocity of the inner stretch of the belt is not the same as the peripheral velocity of the ampules in the seat these ampules will rotate about their upright longitudinal axes as they move along the transport path. Such rotation is a considerable aid in filling the ampules and in hermetically sealing them.

In accordance with another feature of this invention the pressing means is an array of angularly equispaced pressing wheels carried on a support that rotates jointly with the support plate of the rollers. Each of these wheels is engageable between a pair of the rollers so as to press a respective ampule into a respective seat. Furthermore each of these wheels is carried on an upright shaft or pin assembly which is tippable for displacement of the wheel toward and away from the upright rotation axis of the support plate. Means is provided urging these wheels radially inwardly, and for rotating all of these wheels jointly. Thus it is possible for ampules of virtually any size to be loaded into the apparatus without having to adjust the pressing means. A fixed guide ring centered on the rotation axis of the support plate has an inner periphery of varying radius on which ride wheels or rollers each carried on a respective shaft assembly for each pressing wheel. At locations along the transport path, such as the input and output ends thereof, the periphery diverges radially inward so that the pressing wheels at these locations are pulled away from their respective ampules. In addition means in the form of telescoping shaft section is provided for lowering the support wheels at these locations, thereby allowing the ampules readily to be unloaded from the apparatus.

According to yet another feature of this invention there is provided an input magazine for empty ampules at the input end of the path and an output magazine at the output end of the path. An auger is provided at the input magazine and is synchronously rotated with the support plate so as carefully to feed the empty ampules into the apparatus. In this manner breakage of the ampules is almost completely ruled out.

In accordance with yet another feature of this invention sensing means is provided adjacent the filling tool for detecting the presence of an ampule in a seat under the filling tool. This means serves to block the filling operation should there for some reason be no ampule present in the filling station at the filling position. Thus the apparatus is protected in that a charge of liquid will not simply be sprayed over the machine in case of faulty ampule feed.

It is also possible in accordance with the present invention to form the sealing means as an apparatus for threading screw caps onto the top of the ampules which in this case would be simple bottles. Such a device operates with relative ease because the ampules or bottles rotate about their own longitudinal axes as they move around the transport path.

BRIEF DESCRIPTION OF THE DRAWING

The above and other objects, features, and advantages of the invention will be more readily apparent from the following description, reference being made to the accompanying drawing in which.

SPECIFIC DESCRIPTION

Figure 1:
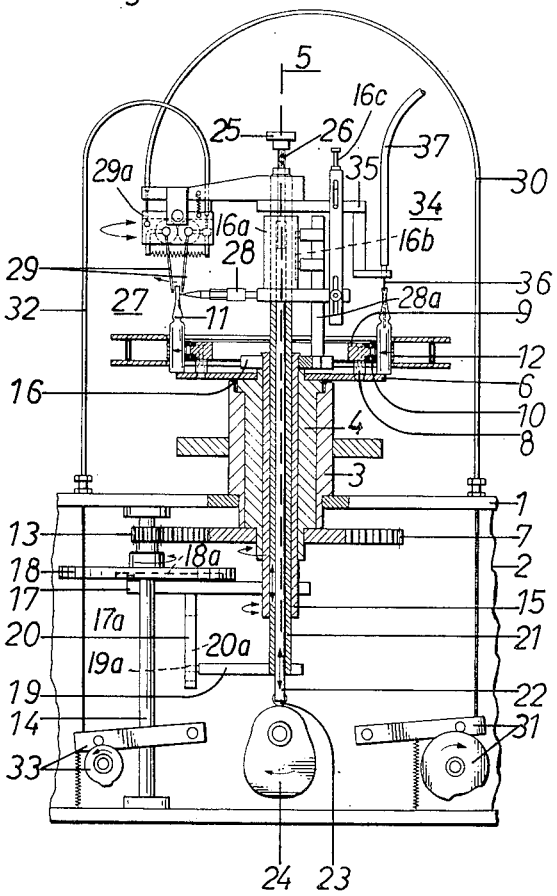
FIG. 1 is a vertical section through an apparatus according to the present invention.
Figure 2:
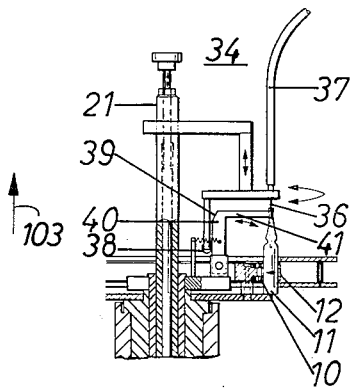
FIG. 2 is a view of a detail of the apparatus of FIG. 1.
Figure 3:
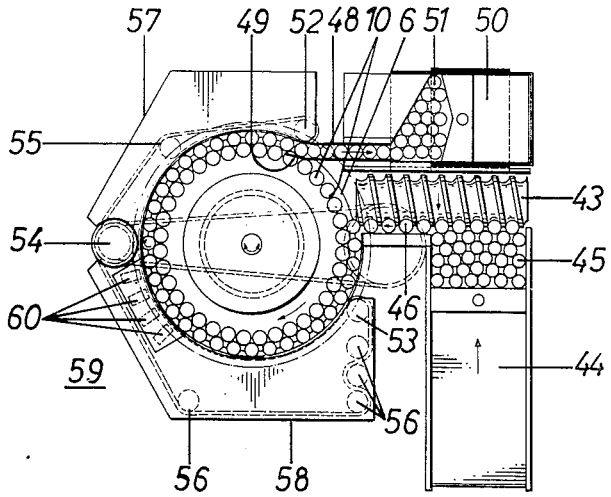
FIG. 3 is a horizontal section through the apparatus shown in FIG. 1.
Figure 12:
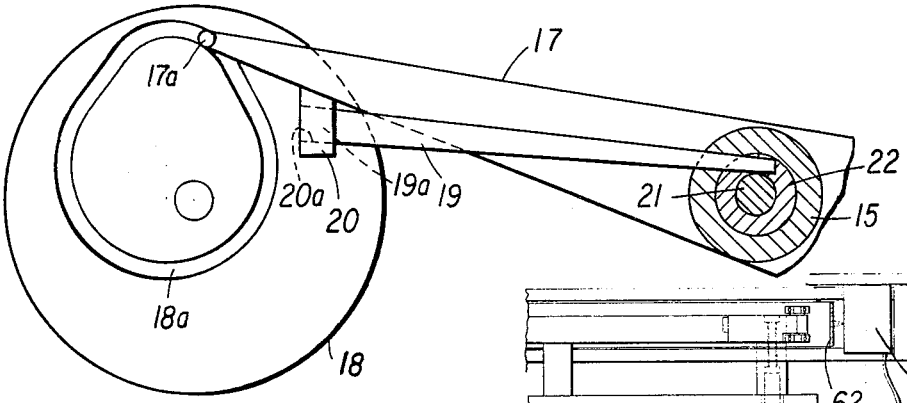
FIG. 12 is a fragmentary bottom view of a portion of the apparatus.

As shown in FIGS. 1 – 3 the apparatus according to the present invention sits on a table 1 standing on legs 2 and has a fixed hollow support column 3 in which is journaled a hollow shaft 4 defining an upright and slightly tipped axis 5. On the upper end of this hollow shaft 4 there is provided a support disc 6 and on the lower end thereof is a gear wheel 7. Concentric to the support disc 6 and separated therefrom by spacers 8 is a ring 9 whose circumference is provided with an array of angularly equispaced rollers 10 whose rotation axes lie on a cylinder centered on axis 5 and having a diameter slightly less than the diameter of the support disc 6. In this manner each roller 10 forms with the adjacent roller 10 a seat adapted to receive a respective ampule 11 whose base rests on the outer edge of the support disc 6. The ampules 11 are pressed into these seats formed by the rollers 10 by the inner stretch of an endless belt 12.

The gear wheel 7 meshes with a pinion 13 that is mounted on a main drive shaft 14 that rotates with constant speed so that the ampules 11 standing on the support disc 6 also orbit around the axis 11 with constant angular and peripheral speed. The direction and peripheral speed of the belt 12 determines the rotation sense and speed of the ampules 11.

A second hollow shaft 15 is rotatable within the hollow shaft 4 and on its upper end a tool support 16 and on its lower end a crank 17 of a slave-cam arrangement whose slave cam 18 is mounted on the main drive shaft 14. The slave cam itself is so shaped that the second hollow shaft 15 has a periodic back and forth pivoted oscillation whose forward motion, that is in the transport direction of the ampules on the plate 6, has a constant angular velocity equal to that of the ampules 11 on the transport disc 6. The backward movement is substantially faster. The gear ratio between the wheel 7 and the pinion 13 corresponds to the ratio of the number of ampules treated at a single time and the total number of postions on the disc 6. Thus with the present device wherein there are 36 seats on the disc 6, although only 32 are used, the tool carrier 16 makes 36 back and forth oscillations for one complete revolution of the disc 6.

Axially slidable within the second hollow shaft 15 and also rotatable therein, is a third hollow shaft 21 provided at its lower end with a laterally extending arm 19 and an outrigger 20 on the end of this arm 19. In addition axially displaceable within the hollow shaft 21 is a rod 22 having at its lower end a roller 23 sitting on a cam 24 rotatable about a horizontal axis and directly connected to the main drive shaft 14 by a transmission (not shown). A threaded spindle 26 provided with a knob 25 at the upper end of the shaft 22 determines the axial position of the shaft 22 in the sleeve 21. Thus the shaft 21 oscillates back and forth jointly with the shaft 15 but is vertically displaceable therein. A sealing station 24 has a torch 28 mounted on a bar **28*a* carried by holder 16 and engaging a sleeve 16*a* at its vertical slot 16*b*. The sleeve 16*a* is vertically shiftable with the torch by an adjustable screw 16*c* on bar 35 which carries the tongs head 29*a* at the top of sleeve 21 and secured to the upper end of the sleeve. The torch is thus mounted at a level so as to direct its flame to the point of an ampule 11. The cam 24 is so shaped and driven that after the burner 28 has been directed at the poknt of the ampule for a time sufficient to soften the glass, it pushes the rod 22 and sleeves 21 upward. Meanwhile a pair of tongs 29 have gripped the very uppermost tip of the point so that the burner 28 lifts the tongs 29 axially displaceable therewith to pull this top up and seal off the upper end of the ampule 11, thereby removing this tip and rounding off the ampule point so formed. Opening and closing of the tongs 29 is controlled by a bowden cable 32 operated by a cam arrangement 33. These tongs at the top of their upward displacement are tipped outwardly by means of a bowden cable 30 operated by a respective cam arrangement 31. The cam arrangements 31, 33 and 24 are all so timed that the upper end of the softened tip of the ampule is pulled off and dropped outside the plate 6**.

The cam 18*a* has a groove in which the pin 17*a* of the crank 17 engages, the crank 17*a* being freely rotatable on the outer hollow shaft 15. The bar 20 which extends downwardly from the crank 17 and is rigid therewith, has a slot 20*a* in which the pin 19*a* of the rod 19 engages, this rod 19 being affixed to the sleeve or inner hollow shaft 21. The thread 26 adjusts the vertical postion of the follower 23 with respect to the lower end of the hollow shaft 21. Thus both the hollow shaft 21 and the rod 22 in turn move vertically and angularly together except when the screw 26 is used for adjustment and, in this case, relative vertical or axial movement of rod 22 and hollow shaft 21.

Rotation of cam 24, therefore, vertically displaces both the rod 22 and the hollow shaft 21 such that the pin 19*a* of rod 19 rides vertically in the slot 20*a* of bar 20. Since the bar 20 is rigid with the crank 17 and the latter is angularly displaced, hollow shaft 22 is angularly displaceable about its vertical axis as already noted.

Since support 16 is at a fixed level on the shaft 15, it is angularly displaced via the sleeve 16*a* and bar 28*a* with angular displacement of hollow shaft 21 although the height of head 29*a* and member 35 with respect to the torch 28 and the holder 16 can be adjusted by screw 16*c*.

Generally diametrically opposite the sealing station 27 there is a filling station 34 which has a filling needle 36 carried on an outrigger arm 35 secured to the upper end of the shaft 21. A flexible conduit 37 extends from the filling needle 36 and is connected through a valve to a supply of the fluid product to be filled into the ampules 11 as will be described hereinbelow. Before the point of the filling needle 36 enters into the upper end of the tip of the unsealed ampule a roller 38 secured on the outrigger arm 35 rides against an inclided surface 39 of a swinging double-arm lever 44 which is formed at one end with a centering fork 41 that engages around the tip of the empty ampule and centers it directly below the filling needle 36. The elasticity of the belt 12 holding the ampules 11 against the rollers 10 allows the ampules to be tipped relatively far without breaking, so that even ampules with very eccentric tips will be filled without difficulty.

FIG. 3 shows how the input slide 42 of the machine has a feed auger or screw 43 which rotates at a speed which is constant and determined by the rotation speed of the disc 6. An empty-ampule magazine 44 contains a mass of empty upright ampules 45 which are fed through an input channel 46 by the auger 43 to the seats between a pair of adjoining guide rollers 10. Next to the ampule-input station 42 is an ampule-output station 47 with an outlet canal 48 that is provided with a lift-off tongue 49 that is spaced slightly above the upper rollers 10 and serves to pull the filled and sealed ampules 51 off into a magazine 50. Obviously the magazines 45 and 50 are right next to each other so that a single operator can oversee proper feed both at the input and output ends of the conveyor path around the disc 6.

The belt 12 is spanned over a pair of pulleys or rollers 52 and 53, the former being immediately upstream of the output station 47 and the latter being immediately downstream of the input station 42. A drive pulley 54 engaged between the outer stretch and inner stretch of the belt 52 is connected to its own variable-speed drive. The pulleys 52 and 53 are rotatable about parallel axes and the outer stretch of the band is held away from the inner stectch by means of idler pulleys 55 and 56. The belt 12 is coplanar in FIG. 3.

Figure 11:
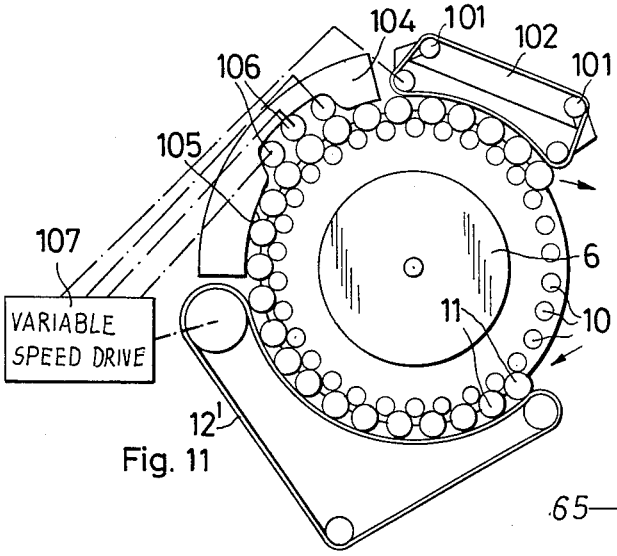
FIG. 11 is a view corresponding to FIGS. 9 and 10 indicating another apparatus in accordance with this invention.

It should also be noted that instead of being coplanar the belt can be deflected as show in FIG. 11 out of its plane, that is the plane of the disc 6, by means of deflecting roller 101 which operate on a small belt 102 used only adjacent the output end of the conveyor path. A similar belt may be provided at the input end.

Pulleys 52 – 56 are mounted on two separate holders 57 and 58 which are displaceable as shown by arrow 103 in FIG. 1 parallel to the axis 5 and which also can be swung out about the rotation axis of the separating pulley 54 so as to allow access to the machine and adjustment for ampules of different diameters.

The axis 5 of the apparatus is as discussed above not perfectly vertical but is tipped somewhat to the vertical. This angle of tip is such that the input and output stations 42 and 47 lie at the uphill side of the disc 6. This arrangement facilitates feed and also prevents any liquid on the plate 6 from collecting there and creating a problem.

Figure 4:
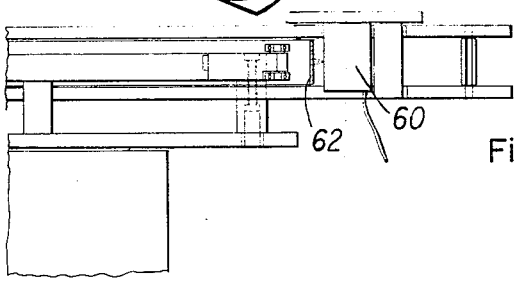
FIG. 4 is a large-scale detail view of a portion of the apparatus of FIG. 1.
Figure 5:
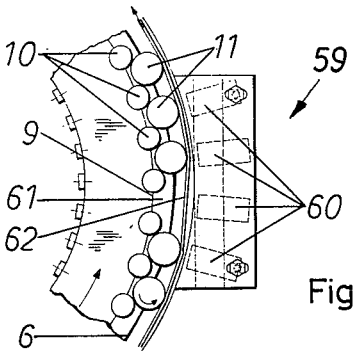
FIG. 5 is a top view of a detail of FIG. 4.

As shown in FIGS. 4 and 5 feed stations 59 provided with sensors 60 are provided for determining whether there are ampules 11 in the seats between the rollers 10 underneath the filling station 34. Each detector 60 comprises a photoelectric cell and a small light which are both focused on the belt 12 at the position it would assume if it overlies an ampule 11. When the belt 12 is deflected inwardly as shown at 62 over an empty seat 61 the detector will not receive the proper amount of reflected light and will therefore indicate that the station 61 is empty. This will cause an output signal to be fed to a control device that will prevent the filling arrangement from operating at the empty station 61. It is also possible to use instead of the photoelectric sensors 60 a simple microswitch physically detecting the position of the band.

Figure 6:
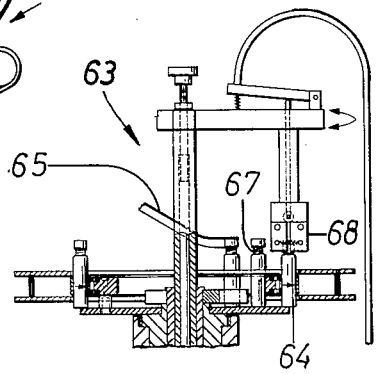
FIGS. 6 and 7 are side and top views, respectively, or a bottle cap applied usable with the apparatus of FIG. 1.
Figure 7:
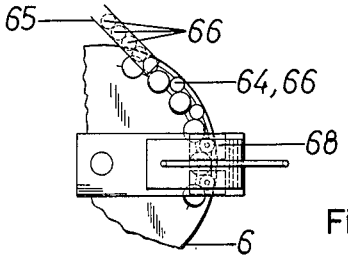

FIGS. 6 and 7 show a bottle-cap mounting arrangement 63 adapted to operate on bottles or ampules 64 with threaded necks 67. Bottle caps 66 are fed to the station 63 by a chute 65 and are held on the rotating bottle 64 by a clamp 68. As the bottle 64 rotates about their longitudinal upright axes these caps 66 are automatically threaded onto the necks 67.

FIG. 11 also shows a fixed compressing element 104 having a circularly arcuate pressing surface 105 which is fixed relative to the disc 6 and which serves to press the ampule 11 between the rollers 10. Several rollers 106 at this surface 105 are driven by the variable speed drive 107 of the arrangement in order to rotate the ampules 11 at high speeds at a location underneath the filling station. Otherwise the device has a belt 12' operating at the input end as is described above.

Figure 8:
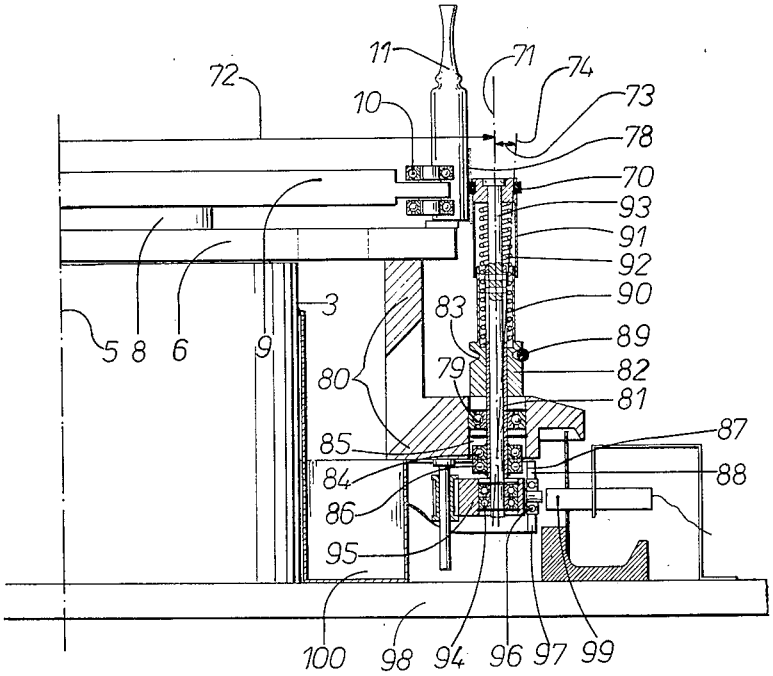
FIG. 8 is a vertical section through a detail of another arrangement in accordance with this invention.
Figure 10:
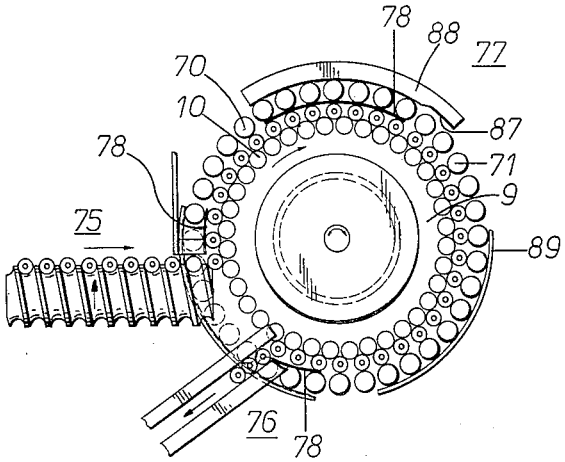
FIG. 10 is a horizontal section through another apparatus embodying the arrangement of FIG. 8.

The arrangement shown in FIGS. 8 and 10 uses the same reference numerals as the structue of FIGS. 1 – 3 for identical structure. Here however the belt 12 is replaced with an array of wheels 70 of elastomeric material normally rotatable about respective upright axes 71 parallel to the axis 5. Each axis 71 is tippable about a radius of curvature 72 through an angle 73 into a position indicated at 74 away from the axis 5. In this latter position the wheel 70 is out of engagement with a respective ampule 11. The wheels 70 are tipped into this outer position 74 at the input end 75 and output 76 of the apparatus as well as at an intermediate station 77 (FIG. 10) where holding plate 78 is used to ensure proper positioning of the ampules 11.

This tipping is made possible by a ball or barrel bearing 79 which is secured in an annular support 80 which is secured to the disc 6 and jointly rotatable therewith. The bearing 79 has a hollow shaft 81 on whose upper part a drive wheel or pulley 82 with a groove 83 is mounted and on whose lower part is secured another bearing 84 which is radially displaceable in a radially elongated slot 85 in the support ring 80. The axes 71, 74, and 75 are all coplanar. On the lower end of the hollow shaft 81 there is freely rotatably mounted a guide roller or wheel 86 which is engageable on the inner side 87 of a fixedly mounted guide ring 88 secured to the table 98. This guide ring 88 has a varying inner radius whose lesser value effects the lifting of the respective wheel 70 from the respective ampule 11 by inwardly pressing the roller 86. As shown in FIG. 8 when the inner edge 87 is spaced from the roller 86 the wheel 70 lies against the respective ampule 11. A drive belt 89 operated by a variable speed drive is reeved in the groove 84 of the pulley 82 so as to rotate the wheel 70 and thereby cause the ampule 11 also to rotate.

The pulley 82 is secured on its upper side with a lower telescoping sleeve 90 itself received in an upper telescoping tube 91 rotationally coupled thereto and itself secured to the wheel 70. A compression spring 92 is raced between the wheel 70 and the pulley 82 so as to normally urge the wheel 70 into the position illustrated in FIG. 8. A pin 93 secured at its upper end to the wheel 70 and passing through the hollow shaft 81 is provided on its lower end with a bearing 94. A guide body 95 is secured to this lower end near the bearing 94 and is itself provided with a guide roll 96 with a radially extending axis and upwardly pressing by means of the spring 92 against the lower surface 97 of the ring 88. This lower surface 97 is similarly of varying height so as to lower the wheel 70 in the region of the input and output ends 75 and 76, thereby allowing the ampules readily to be loaded into and removed from the apparatus.

Figure 9:
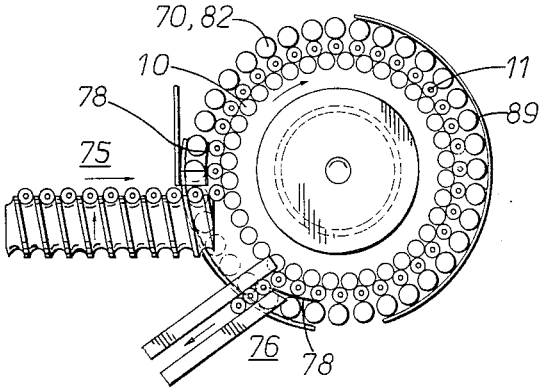
FIG. 9 is a horizontal section through an apparatus embodying the arrangement of FIG. 8.

Adjacent to the filling station there is provided a sensor 99 which detects the nearness of the respective body 95. When no ampule is present in the respective seat the axis 71 will be radially inwardly of the position illustrated in FIG. 8 so that the detector 99 will sense this changed postion and prevent operation of the filling device as described above. It is also possible as shown in FIG. 9 to eliminate the ring 88.

FIG. 8 also shows how the support 80 is formed with a row of throughgoing holes so that splinters from accidentaly breaking ampules 11 can be collected below this ring 80 in a trough 100 provided for this purpose. This trough 100 sits on the base 98 of the apparatus.

The apparatus according to the present invention rapidly and automatically fills and seals ampules. It can readily be set up for ampules of varying dimensions and is very gently in operation so that the likelihood of breaking an ampule is almost completely eliminated. Moreover due to the constantly spinning of the ampules they fill without bubbles and indeed are sealed perfectly.

We claim:

1. An apparatus for filling and sealing ampules, said apparatus comprising:

means defining a transport path having an input end and an output end;

means for advancing a succession of ampules along said path in a transport direction at a substantially constant advancement rate from said input end to said output end;

means along said path including a filling tool for filling said ampules and a sealing tool for sealing said ampules; and means for alternately displacing said tools stepwise at said advancement rate along said path in said transport direction and opposite to said direction at another rate;

said means defining said path including a support plate having a central upright axis, and rotatable about said axis, said plate having a generally circular periphery defining said path and formed with a plurality of angularly equispaced seats each adapted to receive a respective ampule, said means including said tools having a pair of respective supports each limitedly pivotal about said upright axis and carrying a respective tool.

2. The apparatus defined in claim 1 wherein said plate is provided at its periphery with an array of angularly equispaced rollers rotatable about respective axes parallel to said upright axis and each forming one side of a respective seat, the other side of each seat being formed by the adjacent roller, said means for advancing including means for pressing a respective ampule into each seat between two such rollers.

3. The apparatus defined in claim 2 wherein said means for pressing includes an array of rotatable pressing wheels each alignable with a respective seat, means for rotating said wheels in a predetermined rotational sense, and a pivot for each of said wheels establishing therefor a pivot axis displaceable between a pressing position substantially parallel to said upright axis and a tipped position inclined away from said upright axis.

4. The apparatus defined in claim 3 wherein each pivot includes a rotatably mounted tippable upright pin, each wheel being rotatably mounted on a respective pin, said means for rotating said wheels including respective pulleys carried on said pins and each rotationally coupled to a respective wheel and a belt reeved in said pulleys, said apparatus further comprising guide means for displacing said pivot axes into said tipped positions at locations along said path with the respective wheels out of engagement with the respective ampules, said means for pressing including a support journalling said pins and rotatable about said upright axis jointly with said plate.

5. The apparatus defined in claim 4 wherein each pin includes a first sleeve carrying the respective wheel, a second sleeve rotationally coupled to said first sleeve and to the respective pulley and telescoping with said first sleeve, and a tube rotationally coupled to said pulley and provided with a bearing, said support being formed with an array of elongated vertically throughgoing slots each receiving a respective bearing and lying generally radial to said upright axis to define a tipping plane for the respective pivot axis including said upright axis.

6. The apparatus defined in claim 5 wherein said guide means includes a fixed guide ring generally concentric with said axis and having an inner periphery of lesser radius at said location than between said locations and a deflection roller on each of said pins riding on said inner periphery.

7. The apparaus defined in claim 6 wherein said guide ring has an under edge and each pin is connected at its upper end to the respective wheel and is provided on its lower end with a rolling element riding on said under edge, each pivot further comprising means for urging said rolling element against said under edge, whereby said element and said pulley are vertically displaced by said under edge, said under edge being lower at said ends of said path then between said ends.

8. The apparatus defined in claim 4, further comprising means for driving said belt at a variable speed.

9. The apparatus defined in claim 2 wherein said means for pressing includes an endless belt and means for displacing said belt at a peripheral speed different from said advancement rate for rotation of said ampules in said seats.

10. The apparatus defined in claim 9, further comprising means for displacing said belt at a variable peripheral speed.

11. The apparatus defined in claim 9 wherein said means for pressing includes an upstream guide pulley immediately downstream of said input end and a downstream guide pulley immediately upsteam of said output end, said endless belt being reeved in said guide pulleys.

12. The apparatus defined in claim 11 wherein said belt has an inner stretch lying against said ampules in said seats and extending between said guide pulleys along said path between said ends thereof, and an outer stretch extending between said guide pulleys outside said inner stretch relative to said upright axis, said means for displacing said belt including a drive pulley intermediate said guide pulleys and lying between and engaging said inner and outer stretches.

13. The apparatus defined in claim 11 wherein said pressing means includes at least one further idler pulley engaging said outer strecth, said pulleys all having parallel rotation axes, said belt lying substantially in a plane transverse to said upright axis.

14. The apparatus defined in claim 11 wherein said belt has an upstream section and a downstream section, said means for pressing further comprising means for pivoting at least one of said sections away for said plate.

15. The apparatus defined in claim 11 wherein said means for pressing includes means for deflecting said belt from the plane of said plate at one of said ends of said path.

16. The apparatus defined in claim 11 wherein said means for pressing includes means for displacing said belt at least partially parallel to said axis.

17. The apparatus defined in claim 2 wherein said means for pressing includes a fixed pressing surface extending along a least a portion of said path and engageable with said ampules in said portion for imparting rotation thereto.

18. The apparatus defined in claim 17 wherein said means for pressing further includes an endless belt extending along said path adjacent said portion and means for driving said belt.

19. The apparatus defined in claim 17 wherein said means for pressing includes drivable rollers at said surface engageable with said ampules.

20. The apparatus defined in claim 1 wherein said means for advancing said ampules and said means for displacing said tools include a single drive.

21. The apparatus defined in claim 20 wherein said drive includes a cam operatively connected to said supports for said tools.

22. The apparatus defined in claim 20 wherein said drive includes couplings between said means for advancing said ampules and said means for displacing said tools.

23. The apparatus defined in claim 22 wherein said drive includes a cam and a bowden-cable connection between said cam and said sealing tool.

24. The apparatus defined in claim 22 wherein said supports for said tool includes a central shaft lying on said axis and carrying at its upper end said supports, said drive further comprising a cam engaging the lower end of said shaft.

25. The apparatus defined in claim 1, further comprising an input magazine for empty ampules at said input end, an auger at said input magazine extending to said input end, and means for driving said auger to feed said ampules from said input magazine into said input end of said path.

26. The apparatus defined in claim 1 further comprising a trough extending at least partially along said path for catching splinters from said ampules.

27. An apparatus for filling and sealing ampules, said apparatus comprising:

means defining a transport path having an input end and an output end;

means for advancing a succession of ampules along said path in a transport direction at a substantially constant advancement rate from said input end to said output end;

means along said path including a filling tool for filling said ampules and a sealing tool for sealing said ampules;

means for alternately displacing said tools stepwise at said advancement rate along said path in said transport direction and opposite to said direction at another rate; and sensing means adjacent said filling tool for detecting the presence of an ampule in a respective seat and preventing operation of said filling tool on absence of an ampule in such seat;

said means for advancing including an array of pressing wheels, an array of urpright tippable pins each carrying a respective wheel, and means for tipping said pins for urging the respective wheel against a respective ampule in a respective seat, said sensing means including a feeler engageable with said pins adjacent said filling tool for generating a blocking signal when a pin adjacent said filling tool is in a position indicating absence of an ampule in the respective seat.

28. An apparatus for filling and sealing ampules, said apparatus comprising:

means defining a transport path having an input end and an output end;

means for advancing a succession of ampules along said path in a transport direction at a substantially constant advancement rate from said input end to said output end;

means along said path including a filling tool for filling said ampules and a sealing tool for sealing said ampules; and means for alternately displacing said tools stepwise at advancement rate along said path in said transport direction and and opposite to said direction at another rate;

said means defining said path including a support plate having an upright axis inclined to the vertical, said support being rotatable about said upright axis, said ends of said path being adjacent each other and being fixed on the uphill side of said plate.

29. An apparatus for filling and sealing ampules, said apparatus comprising:

means defining a transport path having an input end and an output end;

means for advancing a succession of ampules along said path in a transport direction at a substantially constant advancement rate from said input end to said output end;

means along said path including a filling tool for filling said ampules and a sealing tool for sealing said ampules; and means for alternately displacing said tools stepwise at said advancement rate along said path in said transport direction and opposite to said direction at another rate;

said means for sealing includes means for fitting screw caps to said ampules.

* * * * *